US007485011B2

(12) United States Patent
Hsu

(10) Patent No.: US 7,485,011 B2
(45) Date of Patent: Feb. 3, 2009

(54) ELECTRICAL CONNECTOR

(75) Inventor: Hsiu-Yuan Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/154,378

(22) Filed: May 22, 2008

(65) Prior Publication Data

US 2008/0293302 A1 Nov. 27, 2008

(51) Int. Cl.
*H01R 13/24* (2006.01)

(52) U.S. Cl. ..... 439/700; 439/824

(58) Field of Classification Search ..... 439/700, 439/824

See application file for complete search history.

(56) References Cited

U.S. PATENT DOCUMENTS 4,397,519 A * 8/1983 Cooney ..... 439/824
5,009,613 A * 4/1991 Langgard et al. ..... 439/482
6,053,777 A * 4/2000 Boyle ..... 439/700

* cited by examiner

*Primary Examiner*—Tho D Ta
(74) *Attorney, Agent, or Firm*—Wei Te Chung

(57) ABSTRACT

An electrical connector includes an insulating housing and a plurality of contacts received in the insulating housing. Each contact has a first terminal and a second terminal which has a base portion and a leading arm extending from said base portion. Said base portion and a leading arm define a receiving space for receiving said first terminal. The leading arm has at least one mating bender protruding into said receiving space. The mating bender has a smooth convexity on an inner surface of said receiving space for mating with the first terminal, which alleviates the abrasion between said first terminal and said second terminal and brings a stable connection between the first terminal and the second terminal.

7 Claims, 8 Drawing Sheets

ELECTRICAL CONNECTOR

BACKGROUND OF THE INVENTION

1. Field of the Invention

The present invention relates to an electrical connector, and more particularly to an electrical connector connecting an IC (Integrated Circuit) package to a printed circuit board.

2. Description of Related Art

Various types of connectors have been developed for electrically connecting an IC package and a printed circuit board, such as test socket connector receiving an IC package for testing. Contacts resided within the socket are classified as PGA (Pin Grid Array) contacts, BGA (Ball Grid Array) contacts, LGA (Land Grid Array) contacts and so on. Each of said contacts usually has a contacting pin mating with said IC package. The connection between said contacting pin and the IC package usually influences the whole test.

Referring to FIGS. 7 and 8, a contact used in a conventional electrical connector (not shown) for connecting with an IC package (not shown) includes a first contacting pin 10' mating with said IC package (not shown), a second contacting pin 20' holding said first contacting pin 10' and a spring component 30'. The second contacting pin 20' includes a base portion 21', two leading portions 22' extending upwardly from two sides of the base portion 21' and a solder tail 23' mounted on a printed circuit board. Said base portion 21' and the leading portions 22' of the second contacting pin 20' together define a receiving space, in which the first contacting pin 10' and the spring component 30' are slidably received. Each leading portion 22' of said second contacting pin 20' has a mating portion 221' mating with said first contacting pin 10'. Said mating portion 221' has a mating surface 2211' formed by incising, so that the mating surface 2211' between the first contacting pin 10' and the leading portion 22' is rough, which makes the first contacting pin 10' get frayed easily while the first contacting pin 10' is sliding in the receiving space. As a result, the connection between the first contacting pin 10' and the second contacting pin 20' will be unstable, which will further make the connection between the first contacting pin 10' and IC package (not shown) unstable. So it is necessary to provide a new electrical connector to solve the problems above.

SUMMARY OF THE INVENTION

Accordingly, an object of the present invention is to provide an electrical connector, in which the contacts are prevented from getting frayed.

In order to achieve above-mentioned object, an electrical connector is provided which comprises an insulating housing having plurality of passageways and a plurality of contacts received in said passageways. Each contact has a first terminal and a second terminal having a receiving space for receiving said first terminal, said second terminal has at least one convexity formed on an inner surface of said receiving space for mating with said first terminal.

Other objects, advantages and novel features of the present invention will become more apparent from the following detailed description of the present embodiment when taken in conjunction with the accompanying drawings.

DETAILED DESCRIPTION OF THE INVENTION

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Figure 1:
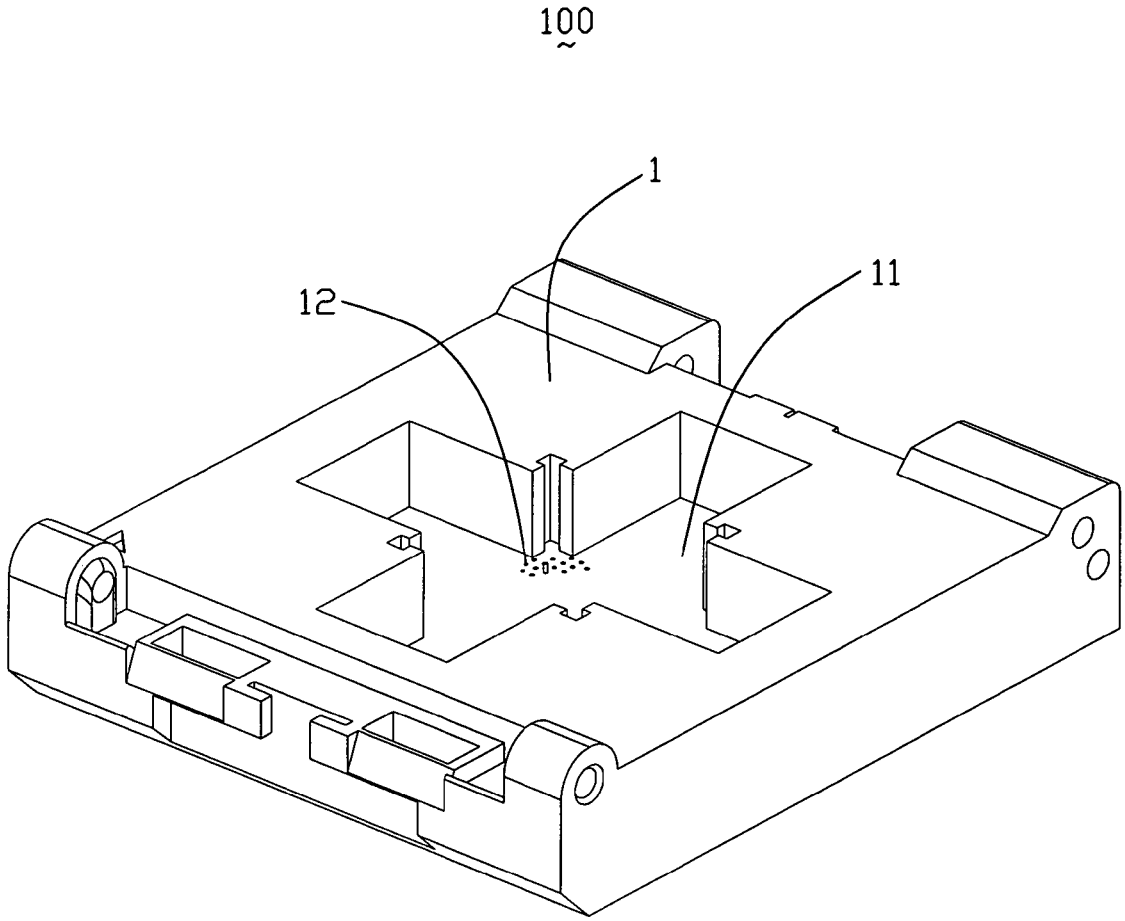
FIG. 1 is an assembled, perspective view of an electrical connector in accordance with an embodiment of the present invention.
Figure 2:
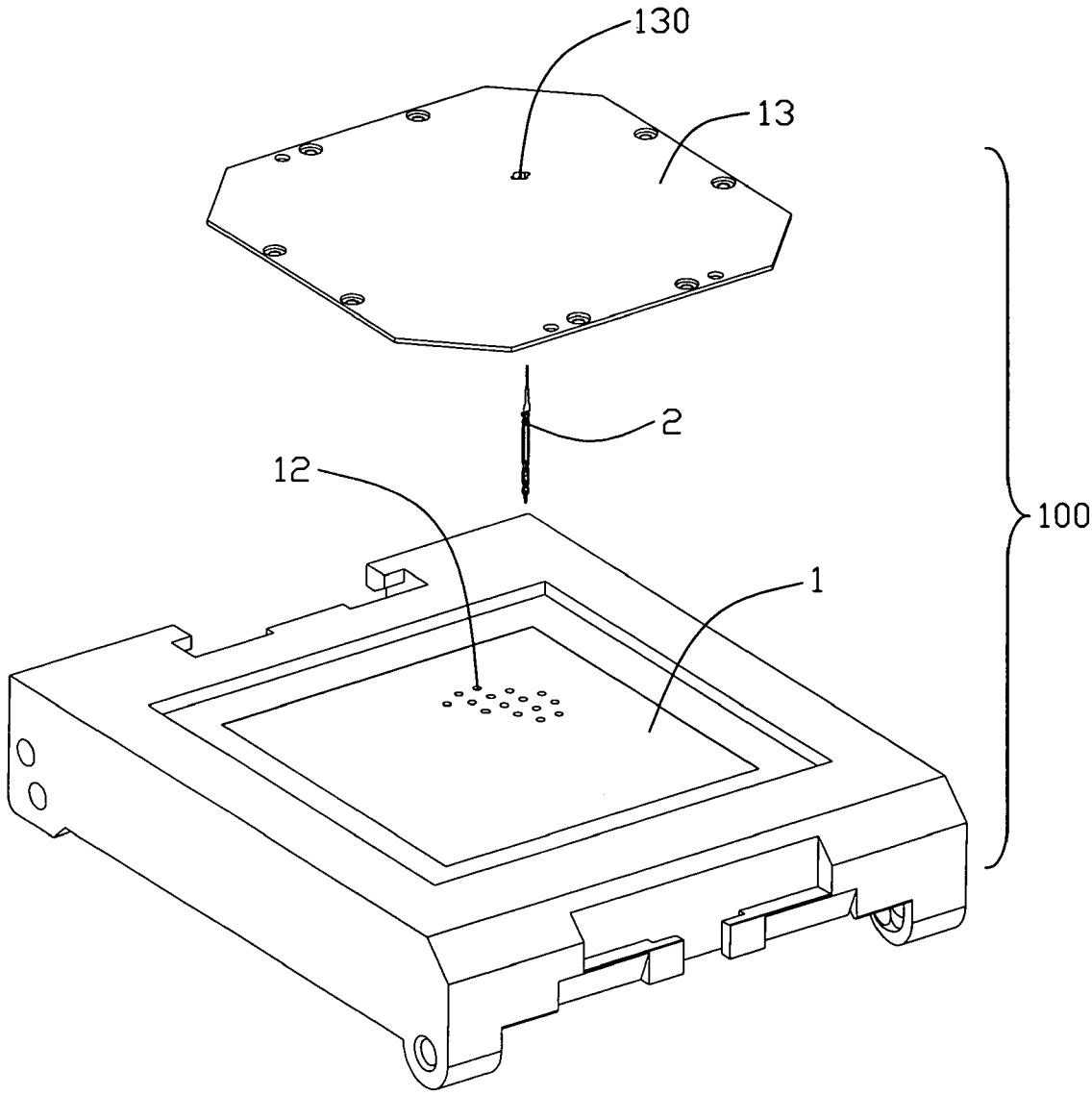
FIG. 2 is an exploded, perspective view of the electrical connector in accordance with the embodiment of the present invention, taken from a bottom side.

Referring to FIGS. 1 and 2, an electrical connector 100 in accordance with the present invention is provided for receiving an IC package (not shown). The electrical connector 100 comprises an insulating housing 1, a plurality of contacts 2 retained in the insulating housing 1 and a cover 13 assembled to a bottom of said insulating housing 1 and having a plurality of holes 130 for receiving said contacts 2.

The insulating housing 1 has a square body with a receiving groove 11 in a center thereof to receive the IC package (not shown). Said body has a plurality of receiving passageways 12 through on a bottom of said receiving groove 11 for receiving said contacts 2.

Figure 3:
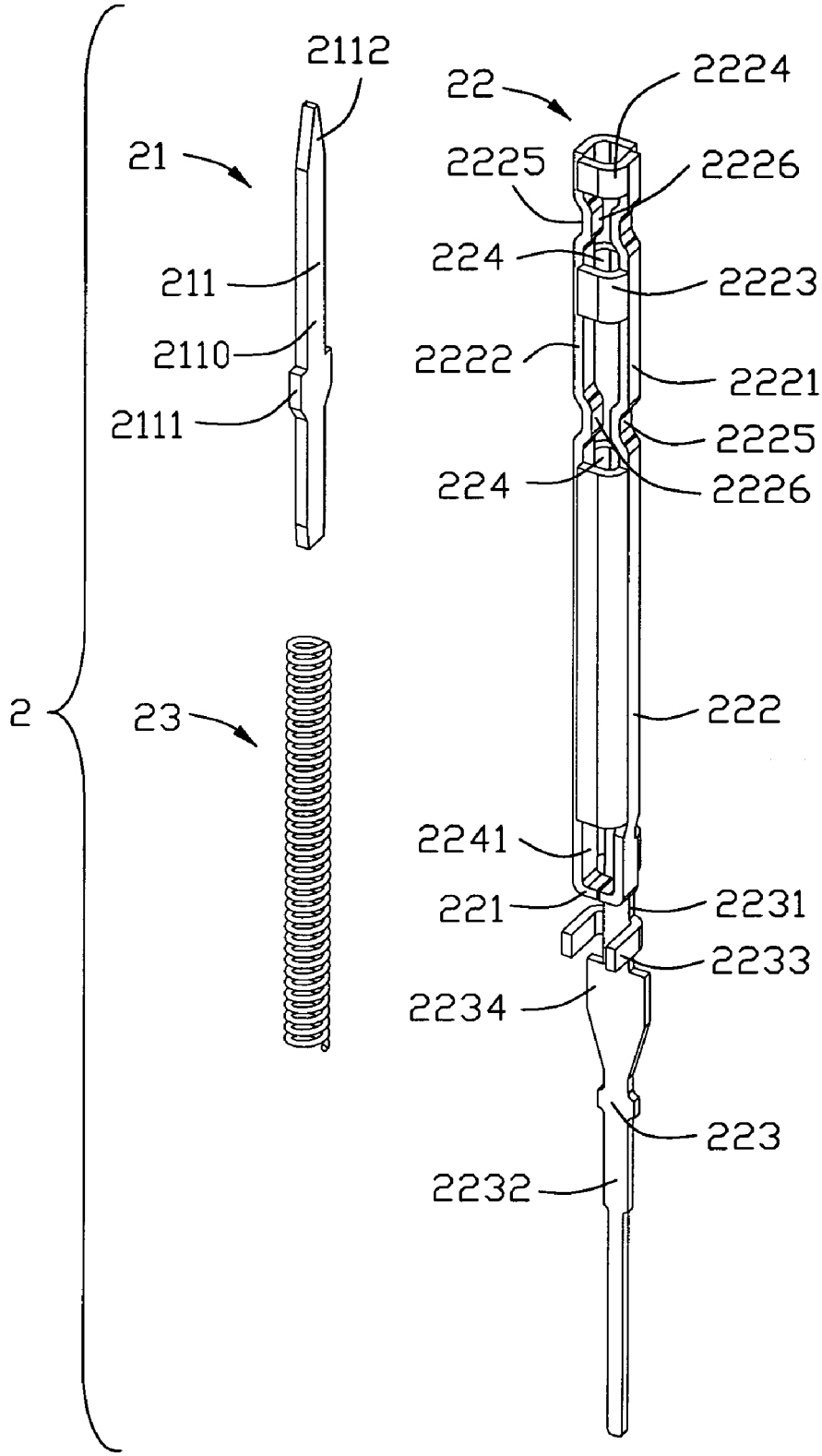
FIG. 3 is an exploded, perspective view of a contact of the electrical connector in accordance with the embodiment of the present invention.
Figure 4:
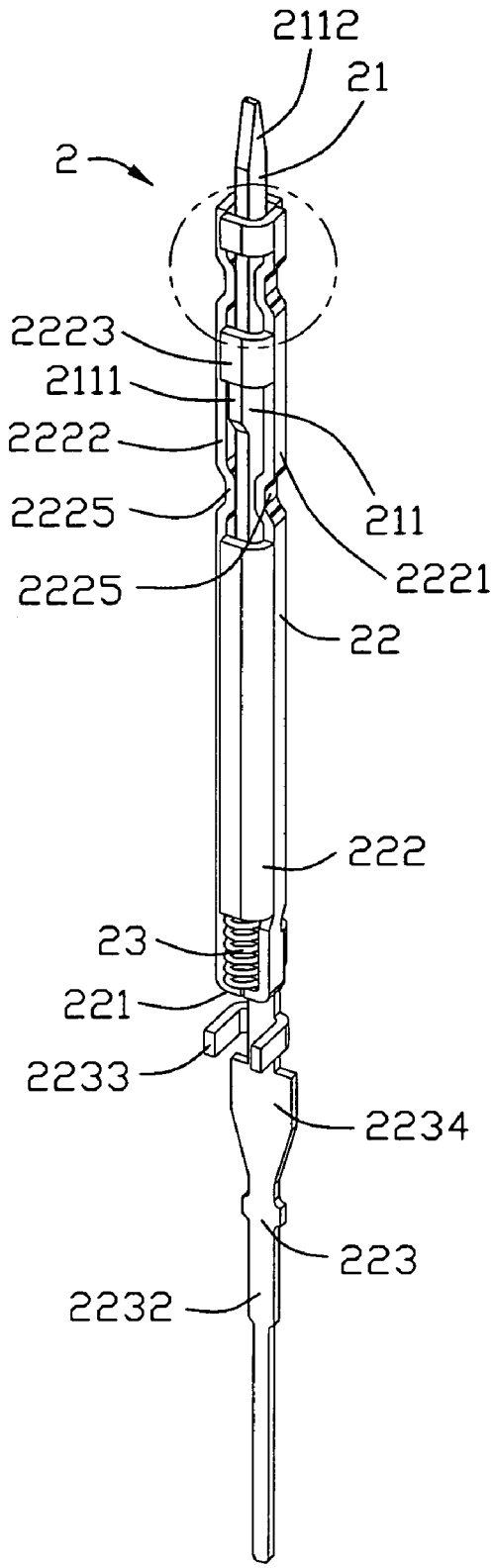
FIG. 4 is an assembled, perspective view of the contact shown in FIG. 3.

Referring to FIGS. 3 and 4, each said contact 2 received in said receiving passageway 12 comprises a first terminal 21, a second terminal 22 for receiving said first terminal 21 and a spring component 23 engaging with said first terminal 21 and the second terminal 22.

The first terminal 21 is stamped from a piece of metal and has a long main body 211 and a pair of protrusions 2111 extending from two sides of said main body 211 respectively. The main body 211 has two mating surfaces 2110 formed by pressing in order to mate with said second terminal 22. The top end of the main body 211 has a trigonal mating portion 2112 extending into said receiving groove 11 so as to mate with said IC package (not shown). The main body 211 has a bottom end engaging with said spring component 23.

Figure 5:
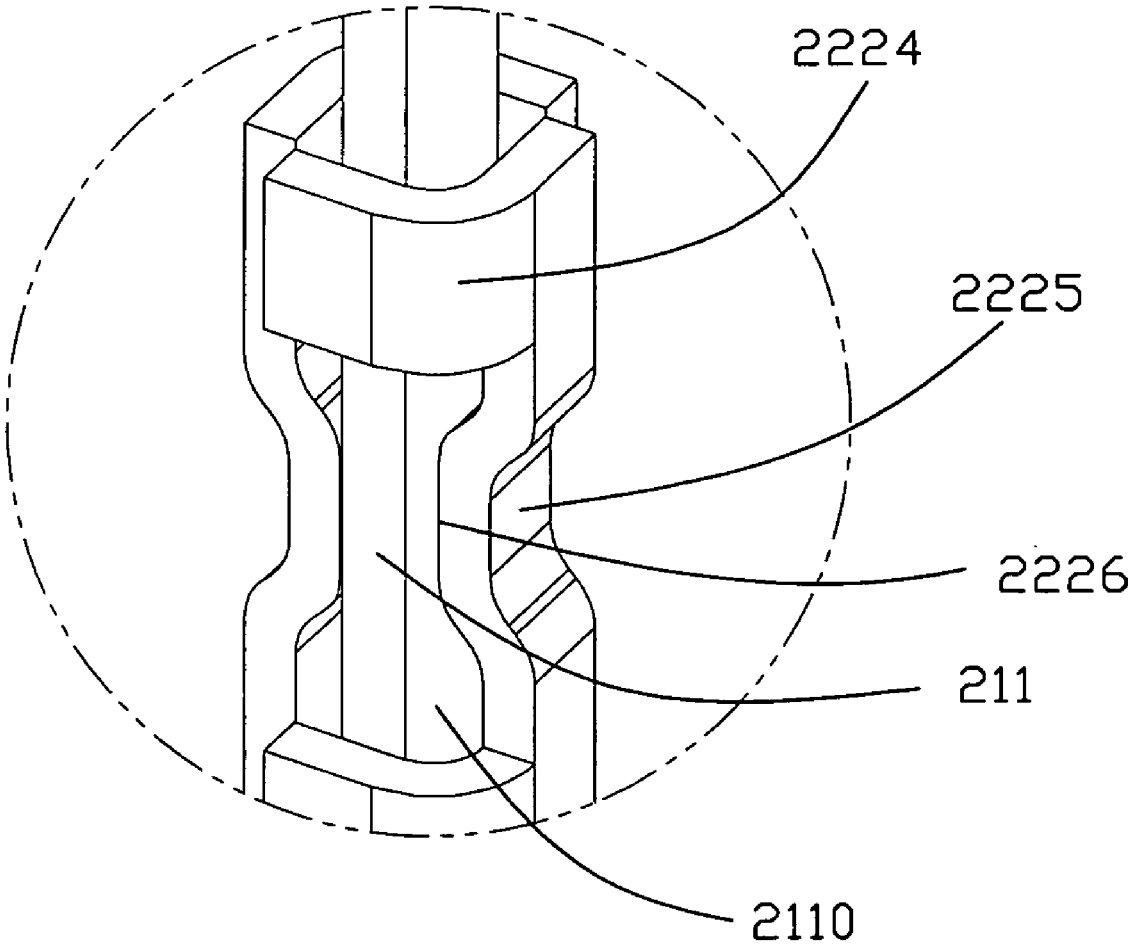
FIG. 5 is a partial enlarged view of the contact shown in FIG. 4.
Figure 6:
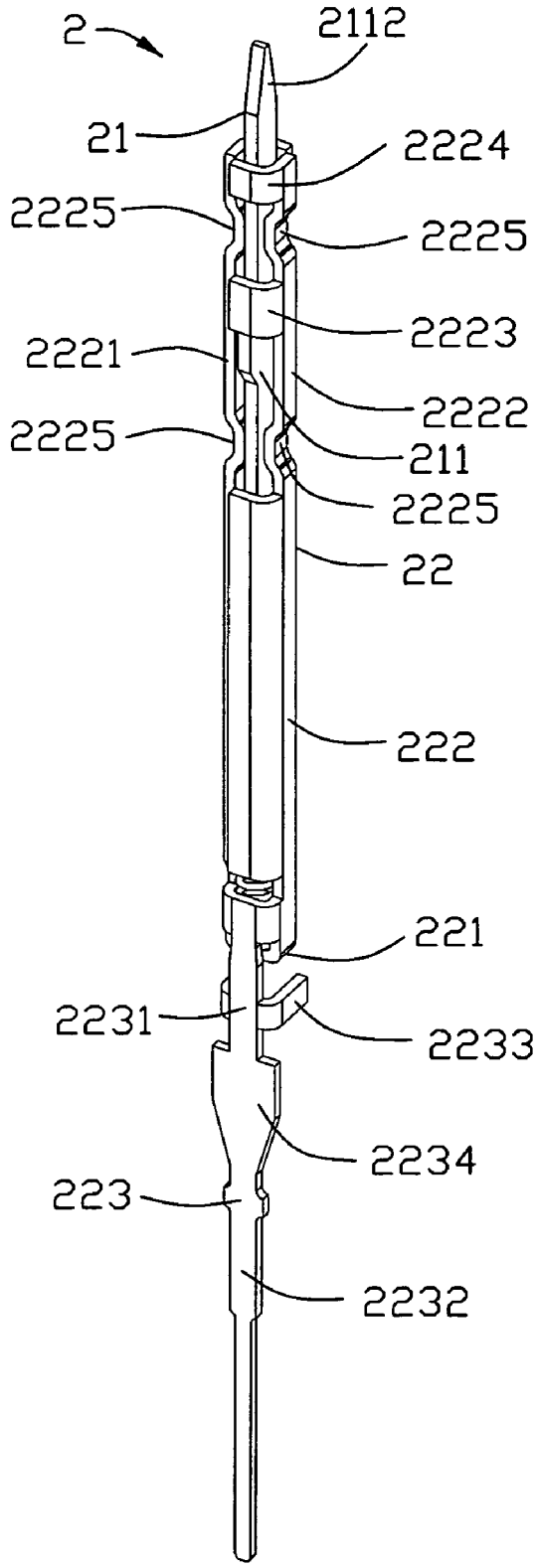
FIG. 6 is an another assembled, perspective view of the contact shown in FIG. 4.
Figure 7:
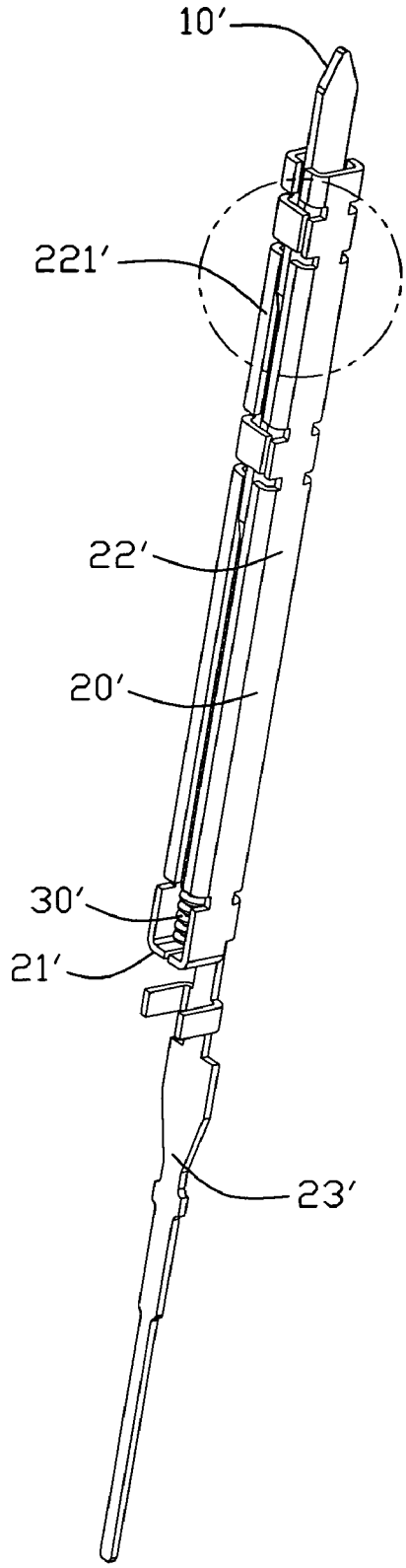
FIG. 7 (PRIOR ART)
FIG. 7 is an assembled, perspective view of a contact in prior art.
Figure 8:
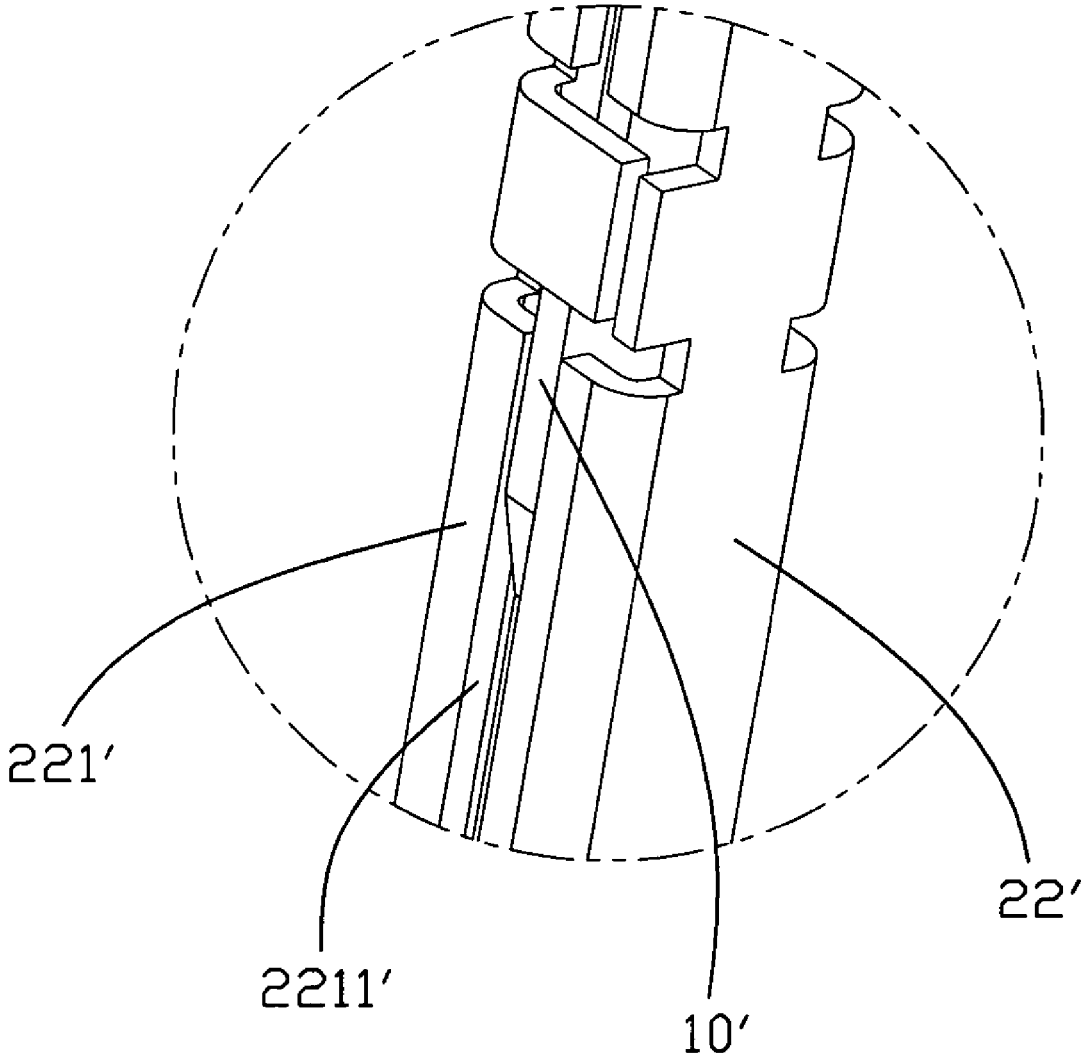
FIG. 8 (PRIOR ART)
FIG. 8 is a partial enlarged view of the contact shown in FIG. 7.

Referring FIGS. 3, 4 and 5, said second terminal 22 receiving said first terminal 21 includes a base portion 221, a leading arm 222 extending upwardly from two sides of the base portion 221 and a tail portion 223 beneath said base portion 221. Said base portion 221 and said leading arm 222 together form a receiving space 224 for receiving said first terminal 21. Said receiving space 224 has a U-shaped receiving portion 2241 on a bottom thereof, which is formed by said base portion 221 and said leading arm 222. Said leading arm 222 includes a first arm 2221 and a second arm 2222. Each of the first arm 2221 and the second arm 2222 have a first a first bar 2223 and a second bar 2224 on a side thereof. Said first bar 2223 limits the range of the protrusions 2111 of the first terminal 21 when the first terminal 21 slides in the receiving space 224 upwardly. The leading arm 222 has a pair of mating benders 2225 respectively located on an upside and a downside of the first bar 2223. Each mating bender 2225 inwardly protrudes into said receiving space 224 from the leading arm 222 and has two convexities 2226 on two inner surfaces of the first arm 2221 and the second arm 2222 in order to mate with the mating surfaces 2110 thereof. Said inner surfaces of the first arm 2221 and the second arm 2222 are formed by pressing, so that the convexities 2226 can get a preferable smoothness to make a stable connection between the mating benders 2225 and the mating surfaces 2110. Referring to FIG. 6, the tail portion 223 is formed on a bottom side of the base portion 221 and extends downwardly to define a soldering portion 2232. Said tail portion 223 defines a connecting portion 2231 connecting said soldering portion 2232 and said base portion 221. The connecting portion 2231 forms a pair of arms from two sides thereof to define a U-shaped portion 2233 and a broad portion 2234 beneath said U-shaped portion 2233. The U-shaped portion 2233 is sustained by said cover 13 while the broad portion 2234 is retained in the hole 130 so as to enhance the interference force between the contact 2 and the cover 13.

The spring component 23 is received in a bottom side of said receiving space 224. Said spring component 23 has a top end connecting with first terminal 21 and a bottom end received in said U-shaped receiving portion 2241 and sustained by said base portion 221 of the second terminal 22.

The contact 2 is assembled into said insulating housing 1. Said first terminal 21 can have a movement within said receiving space 224 for mating with the IC package (not shown). The mating surfaces 2110 of the first terminal 21 contact with said convexities 2226 of the second terminal 22.

The electrical connector in embodiment has a firm connection between the first terminal 21 and the second terminal 22 by forming at least one convexity 2226 on an inner surface of the receiving space 224 for mating with the mating surface 2110 of the first terminal 21. Both the mating surface 2110 and the convexity 2226 are formed by pressing with a preferable smoothness, so that they can avoid to get a heavy abrasion, further more a connection between said first terminal 21 and said second terminal 22, and a connection between said first terminal 21 and said IC package (not shown) are stable.

However, while the preferred embodiment of the invention has been shown and described, it will apparent to those skilled in the art that changes and modifications may be made therein without departing from the spirit of the invention, the scope of which is defined by the appended claims.

What is claimed is:

1. An electrical connector comprising:

an insulating housing having a plurality of receiving passageways;

a plurality of contacts received in said receiving passageways, each contact having a first terminal and a second terminal having a receiving space for receiving said first terminal, said second terminal having at least one convexity formed on an inner surface of said receiving space for mating with said first terminal;

wherein said second terminal has a base portion and a leading arm extending upwardly from two sides of said base portion;

wherein said receiving space of the second terminal is formed by the base portion and said leading arm, said convexity protrudes into the receiving space from said leading arm;

wherein the second terminal has a U-shaped receiving portion at a lower portion of said receiving space;

wherein said leading arm has at least one mating bender protrudes into said receiving space in order to form said convexity;

wherein said leading arm includes a first arm and a second arm with a first bar and a second bar respectively thereon;

wherein each first terminal has a main body and a pair of protrusions formed on two sides of said main body for engaging with said first bar upwardly.

2. The electrical connector as claimed in claim 1, wherein the contact includes a spring component received in said receiving space and sustained by said second terminal.

3. The electrical connector as claimed in claim 1, wherein the second terminal includes a tail portion extending downwardly from a side of the base portion, said tail portion has a connecting portion, a broad portion beneath the connecting portion and a soldering portion extending downwardly from said broad portion.

4. The electrical connector as claimed in claim 3, wherein said connecting portion has a pair of arms extending from two sides thereon to define a U-shaped portion.

5. An electrical connector comprising:

an insulative housing defining a plurality of passageways;

a plurality of terminal sets disposed in the corresponding passageways, respectively;

each of said terminal sets including:

a barrel type contact formed by metal sheet and forming a main section essentially defining four sides in a cross-section, and an upper section located above said main section and essentially defining only two opposite sides in the cross-section, said upper section being equipped with opposite upper and lower narrowed regions; and a blade type contact vertically moveably received in the main section and the upper section under a condition that upper and lower portions of said blade type contact are respectively restricted by said narrowed regions;

wherein said upper section defines four sides in the cross-section at two opposite positions respectively adjacent to upper and lower sides of the upper narrowed region;

wherein the blade type contact defines opposite protrusions exposed to the exterior via the upper section where only two sides exist in the cross-section.

6. The connector as claimed in claim 5, wherein the protrusions are stopped by the upper section at a position having the four sides in the cross-section and adjacent to the lower side of the upper narrowed region.

7. The connector as claimed in claim 6, wherein a spring is received in the main section and urges the blade type contact upward to have the protrusions upwardly abut against the upper section at said position.

* * * * *